US009761926B2

(12) United States Patent
Suh

(10) Patent No.: US 9,761,926 B2
(45) Date of Patent: Sep. 12, 2017

(54) ANTENNA AND MOBILE DEVICE THEREWITH

(71) Applicant: Samsung Electronics Co., Ltd, Gyeonggi-do (KR)

(72) Inventor: Young-Hoon Suh, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 96 days.

(21) Appl. No.: 14/792,323

(22) Filed: Jul. 6, 2015

(65) Prior Publication Data

US 2016/0006126 A1 Jan. 7, 2016

(30) Foreign Application Priority Data

Jul. 4, 2014 (KR) ..... 10-2014-0083862

(51) Int. Cl.
*H01Q 1/24* (2006.01)
*H01Q 21/30* (2006.01)

(52) U.S. Cl.
CPC ..... *H01Q 1/243* (2013.01); *H01Q 1/245* (2013.01); *H01Q 21/30* (2013.01)

(58) Field of Classification Search
CPC ..... H01Q 1/243; H01Q 1/245; H01Q 21/30; H01Q 9/0407
USPC ..... 343/700 MS, 702, 872, 873
See application file for complete search history.

(56) References Cited

U.S. PATENT DOCUMENTS

| | | | | |
|---|---|---|---|---|
| 5,929,813 | A * | 7/1999 | Eggleston | H01Q 1/243 343/700 MS |
| 6,388,626 | B1 * | 5/2002 | Gamalielsson | H01Q 1/243 343/700 MS |
| 8,253,633 | B2 * | 8/2012 | Sanz | H01Q 1/243 343/700 MS |
| 2007/0030202 | A1 * | 2/2007 | Lee | H01Q 1/38 343/702 |
| 2009/0051584 | A1 | 2/2009 | Hellsten | |
| 2009/0051620 | A1 * | 2/2009 | Ishibashi | H01Q 1/243 343/897 |
| 2010/0066608 | A1 | 3/2010 | McCarthy et al. | |
| 2012/0064843 | A1 * | 3/2012 | Kim | H01Q 1/243 455/83 |
| 2013/0044041 | A1 * | 2/2013 | Liu | H01Q 1/243 343/878 |

* cited by examiner

*Primary Examiner* — Tho G Phan

(57) ABSTRACT

An antenna of a mobile device is provided. The antenna includes two antennas that are disposed to be stepped from each other, thereby preventing degradation of an OTA characteristic and reducing an SAR. The antenna includes first and second surfaces stepped from each other on the top surface of an antenna carrier, and a low-band antenna emitter disposed on the first surface and a high-band antenna emitter disposed on the recessed second surface.

16 Claims, 14 Drawing Sheets

ANTENNA AND MOBILE DEVICE THEREWITH

The present application is related to and claims priority under 35 U.S.C. §119 to an application filed in the Korean Intellectual Property Office on Jul. 4, 2014 and assigned Serial No. 10-2014-0083862, the contents of which are incorporated herein by reference.

TECHNICAL FIELD

Exemplary embodiments of the present disclosure relate to antenna technology for improving a Specific Absorption Rate (SAR).

BACKGROUND

An antenna mounted in a mobile device is configured to be electrically connected to a main board (RF board) of a main body. For example, in the case of a general monopole antenna device, a feeding end (or a feeding pin) of an antenna radiator is electrically connected to a feeding pad of a main board, whereas a Planar Inverted F Antenna (PIFA) has feeding and grounded configurations.

Therefore, in the case of the PIFA, a feeding end drawn out from an antenna radiator is connected to a feeding portion electrically connected to an RF connector of a main board, and a grounded end (or a grounded pin) drawn out from the antenna radiator is connected to a ground portion electrically connected to a ground portion of the main board.

In general, the antenna radiator of the PIFA device is fixed to an antenna carrier and the antenna carrier is installed in the main board. This is because the radiating performance of the antenna is improved as the size of the radiator, the area of a grounded surface, and the height between the emitter and the grounded surface increase.

In addition, the emission through the antenna is divided into emission in a "near field" and emission in a "far field". The antenna receive sensitivity in a real calling status belongs to the "far field". The "far field" is in proportion to the "near field", and thus, as the strength of the "far field" increases, the strength of the "near field" also increases.

In addition, since the "near field" exerts a direct influence on an SAR value, it is desirable that the mobile device antenna is designed to have the strongest "far field" and the weakest "near field."

SUMMARY

As mobile devices such as smartphones are increasingly used in recent years, interest in the effect of electromagnetic waves occurring in antennas on the human body is rising. Therefore, interest in the SAR, which numerically expresses how harmful the electromagnetic waves of mobile devices are to the human body, is also rising.

As the SAR, which numerically expresses how harmful the electromagnetic waves are to the human body, increases, the electromagnetic waves are more harmful to the human body. Therefore, a permissible level of the SAR is set and the SAR is regulated not to exceed the permissible level.

In reducing the SAR, which is currently at issue, it is necessary to prevent degradation of the emission performance of the existing antenna. That is, there is a need for a method for reducing only a near field area while maintaining far field performance, thereby reducing the SAR.

In the antenna employed in the mobile device, the SAR performance is improved by reducing conduction power to reduce emission power when the SAR of the antenna radiator is high, or by reducing emission power by changing an emission pattern. However, the SAR performance has been improved in spite of the fact that the improvement of the SAR may result in degradation of the Over the Air RF Performance (OTA) characteristic of the mobile device.

To address the above-discussed deficiencies, it is a primary object to provide an antenna that can reduce a SAR while maintaining an OTA characteristic of the antenna, and a mobile device therewith.

According to an aspect of the present disclosure, an antenna of a mobile includes: an antenna carrier; and first and second antenna radiator disposed on one surface of the antenna carrier to maintain their respective effective volumes and disposed to have a height difference there between, thereby maintaining an OTA and reducing an SAR.

According to another aspect of the present disclosure, a mobile device includes: a body; and an embedded antenna including an antenna carrier that is mounted in the body, and first and second antenna radiator that are disposed on one surface of the antenna carrier and disposed to be stepped from each other, thereby maintaining an OTA and reducing an SAR.

According to various exemplary embodiments of the present disclosure, the antenna includes a low-band antenna and a high-band antenna that are disposed to be stepped from each of her, thereby preventing degradation of an OTA characteristic and reducing an SAR.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
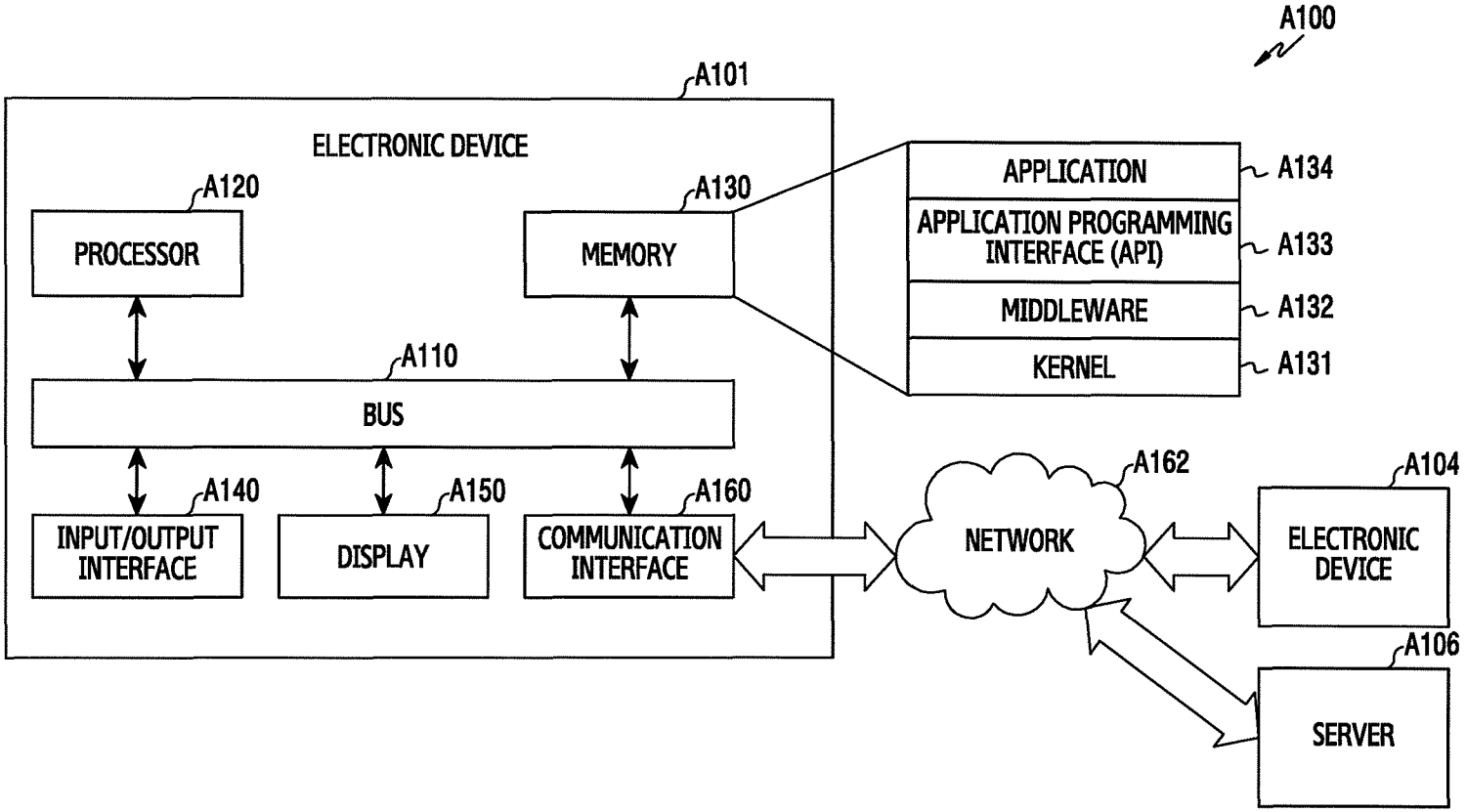
FIG. 1 illustrates a view showing a network environment including a mobile device according to various embodiments.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless communications device. Hereinafter, various exemplary embodiments of the present disclosure will be explained with reference to the accompanying drawings. Although specific embodiments of the present disclosure are illustrated in the drawings and relevant detailed descriptions are provided, various changes can be made and various exemplary embodiments may be provided. Accordingly, various exemplary embodiments of the present disclosure are not limited to the specific embodiments and should be construed as including all changes and/or equivalents or substitutes included in the ideas and technological scopes of exemplary embodiments of the present disclosure. In the explanation of the drawings, similar reference numerals are used for similar elements.

The terms "include" or "may include" used in the exemplary embodiments of the present disclosure indicate the presence of disclosed corresponding functions, operations, elements, and the like, and do not limit additional one or more functions, operations, elements, and the like. In addition, it should be understood that the terms "include" or "have" used in the exemplary embodiments of the present disclosure are to indicate the presence of features, numbers, steps, operations, elements, parts, or a combination thereof described in the specifications, and do not preclude the presence or addition of one or more other features, numbers, steps, operations, elements, parts, or a combination thereof.

The term "or" used in the exemplary embodiments of the present disclosure include any and all combinations of words enumerated with it For example, "A or B" means including A, including B, or including both A and B.

Although the terms such as "first" and "second" used in the various exemplary embodiments of the present disclosure may modify various elements of the various exemplary embodiments, these terms do not limit the corresponding elements. For example, these terms do not limit an order and/or importance of the corresponding elements. These terms may be used for the purpose of distinguishing one element from another element. For example, a first electronic device and a second electronic device all indicate electronic devices and may indicate different electronic devices. For example, a first element may be named a second element without departing from the scope of right of the various exemplary embodiments of the present disclosure, and similarly, a second element may be named a first element.

It will be understood that, when an element is mentioned as being "connected" or "coupled" to another element, the element may be directly connected or coupled to another element, and there may be an intervening element between the element and another element. In contrast, it will be understood that, when an element is mentioned as being "directly connected" or "directly coupled" to another element, there is no intervening element between the element and another element.

The terms used in the various exemplary embodiments of the present disclosure are for the purpose of describing specific exemplary embodiments only and are not intended to limit various exemplary embodiments of the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having ideal or exaggerated meanings unless they are clearly defined in the various exemplary embodiments.

An electronic device according to various exemplary embodiments of the present disclosure can be a device that is equipped with a communication function. For example, the electronic device includes at least one of a smartphone, a tablet personal computer (PC), a mobile phone, a video phone, an electronic book reader, a desktop PC, a laptop PC, a netbook computer, a Personal Digital Assistant (PDA), a Portable Multimedia Player (PMP), an MP3 player, a mobile medical machine, a camera, or a wearable device (for example, a head-mounted-device (HMD) such as electronic glasses, electronic clothing, an electronic bracelet, an electronic necklace, an electronic appcessory, electronic tattoos, or a smart watch).

The electronic device according to various exemplary embodiments of the present disclosure can be one or a combination of one or more of the above-mentioned devices. In addition, the electronic device according to various exemplary embodiments of the present disclosure can be a flexible device. In addition, it is obvious to an ordinary skilled person in the related art that the electronic device according to various exemplary embodiments of the present disclosure is not limited to the above-mentioned devices.

Hereinafter, an electronic device according to various exemplary embodiments will be explained with reference to the accompanying drawings. The term "user" used in the various exemplary embodiments may refer to a person who uses the electronic device or a device that uses the electronic device (for example, an artificial intelligence electronic device).

FIG. 1 illustrates a view showing a network environment including an electronic device according to various exemplary embodiments. Referring to FIG. 1, the electronic device A101 includes a bus A110, a processor A120, a memory A130, an input and output interface A140, a display A150, and a communication interface A160.

The bus A110 is a circuit that connects the above-described elements with one another and transmits communication (for example, a control message) between the above-described elements.

The processor A120 receives instructions from the other elements (for example, the memory A130, the input and output interface A140, the display A150, the communication interface A160, and the like) via the bus A110, decipher the instructions, and performs calculation or data processing according to the deciphered instructions.

The memory A130 stores instructions or data that is received from or generated by the processor A120 or the other elements (for example, the input and output interface A140, the display A150, the communication interface A160, and the like). For example, the memory A130 can include programming modules such as a kernel A131, middleware A132, an Application Programming Interface (API) A133, an application A134, and the like. Each of the above-described programming modules can be configured by software, firmware, hardware, or a combination of two or more of them.

The kernel A131 controls or manages system resources (for example, the bus A110, the processor A120, the memory A130, and the like) that are used for performing operations or functions implemented in the other programming modules, for example, the middleware A132, the API A133, or the application A134. In addition, the kernel A131 provides an interface for allowing the middleware A132, the API A133, or the application A134 to access an individual element of the electronic device A100 and control or manage the element.

The middleware A132 serves as an intermediary to allow the API A133 or the application A134 to communicate with the kernel A131 and exchanges data with the kernel A131. In addition, the middleware A132 performs controlling (for example, scheduling or load balancing) with respect to work requests received from the application A134, for example, by giving priority to use the system resources of the electronic device A100 (for example, the bus A110, the processor A120, the memory A130, and the like) to at least one application.

The API A133 can be an interface for allowing the application A134 to control a function provided by the kernel A131 or the middleware A132, and, for example, includes at least one interface or function (for example, instructions) for controlling a file, controlling a window, processing an image, or controlling a text.

According to various exemplary embodiments, the application A134 includes a Short Message Service (SMS)/Multimedia Messaging Service (MMS) application, an email application, a calendar application, a notification application, a health care application (for example, an application for measuring exercise or a blood sugar), an environment information application (for example, an application for providing information on atmospheric pressure, humidity, or temperature), and the like. Additionally or alternatively, the application A134 can be an application related to information exchange between the electronic device A100 and an external electronic device (for example, an electronic device A104). For example, the application related to the information exchange includes a notification relay application for relaying specific information to an external electronic device or a device management application for managing an external electronic device.

For example, the notification relay application includes a function of relaying notification information generated by other applications of the electronic device A100 (for example, the SMS/MMS application, the email application, the health care application, the environment information application, and the like) to an external electronic device (for example, the electronic device A104). Additionally or alternatively, the notification relay application receives notification information from an external electronic device (for example, the electronic device A104) and may provide the same to the user. For example, the device management application can manage (for example, install, delete or update) a function regarding at least part of an external electronic device (for example, the electronic device A104) communicating with the electronic device A100 (for example, turning on/off the external electronic device (or some parts) or adjusting brightness (or resolution) of a display), an application operating in the external electronic device or a service provided by the external electronic device (for example, a calling service or a message service).

According to various exemplary embodiments, the application A134 includes an application that is specified according to the attribute (for example, a kind of an electronic device) of an external electronic device (for example, the electronic device A104). For example, when the external electronic device is an MP3 player, the application A134 includes an application related to music replay. Similarly, when the external electronic device is a mobile medical device, the application A134 includes an application related to health care. According to an exemplary embodiment, the application A134 includes at least one of an application specified by the electronic device A100 or an application received from an external electronic device (for example, a server A106 or the electronic device A104).

The input and output interface A140 transmits instructions or data inputted by a user through an input and output device (for example, a sensor, a keyboard or a touch screen) to the processor A120, the memory A130, or the communication interface A160 through the bus A110, for example. For example, the input and output interface A140 provides data on a user's touch inputted through a touch screen to the processor A120. In addition, the input and output interface A140 output instructions or data received from the processor A120, the memory A130, or the communication interface A160 through the bus A110 through the input and output device (for example, a speaker or a display). For example, the input and output interface A140 outputs voice data processed through the processor A120 to the user through a speaker.

The display A150 displays a variety of information (for example, multimedia data, text data, and the like) for the user.

The communication interface A160 connects communication between the electronic device A100 and an external device (for example, the electronic device A104 or the server A106). For example, the communication interface A160 can be connected to a network A162 via wireless communication or wire communication to communicate with the external device. The wireless communication includes at least one of Wireless Fidelity (WiFi), BLUETOOTH® (BT), Near Field Communication (NFC), a Global Positioning System (GPS), or cellular communication (for example, LTE, LTE-A, CDMA, WCDMA, UMTS, WiBro, GSM, and the like). The wire communication includes at least one of a Universal Serial Bus (USB), a High Definition Multimedia Interface (HDMI), a Recommended Standard 232 (RS-232), or plain old telephone service (POTS).

According to various exemplary embodiments, the network A162 is a telecommunications network. The telecommunications network includes at least one of a computer network, Internet, Internet of things, or a telephone network. According to an exemplary embodiment, a protocol for communicating between the electronic device A101 and the external device (for example, a transport layer protocol, a data link layer protocol or a physical layer protocol) is supported in at least one of the application A134, the application programming interface A133, the middleware A132, the kernel A131, or the communication interface A160.

Figure 2A:
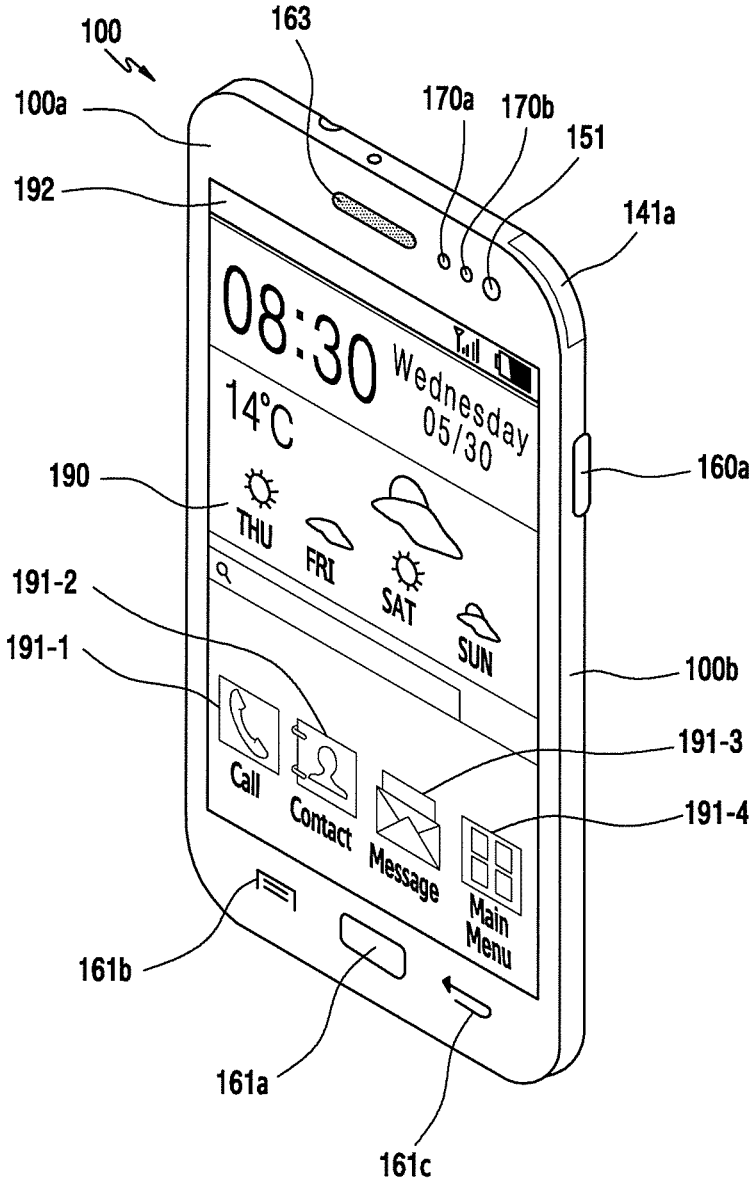
FIG. 2A illustrates a perspective view of a front surface of a mobile device according to various embodiments.
Figure 2B:
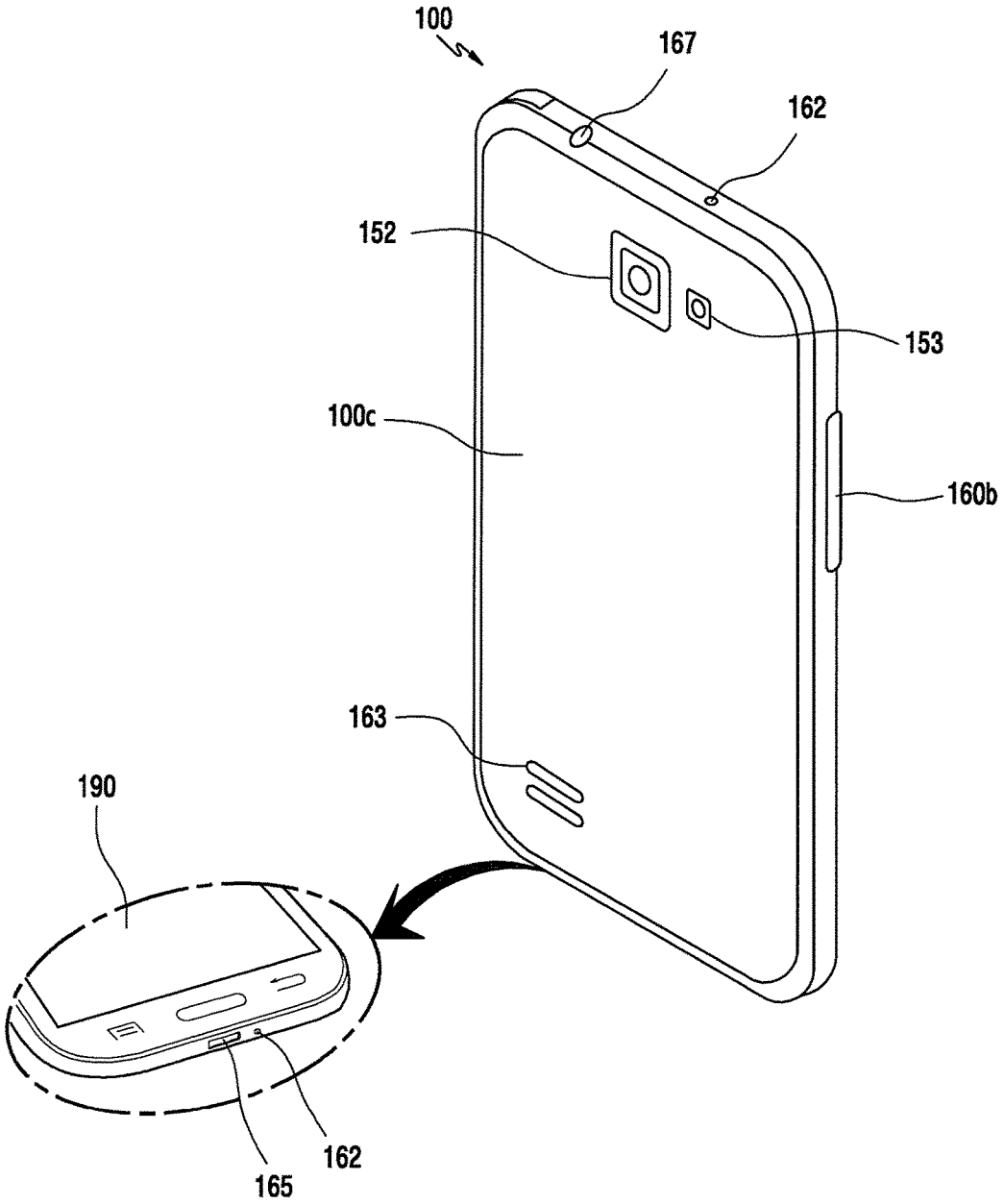
FIG. 2B illustrates a perspective view of a rear surface of a mobile device according to various embodiments.

FIG. 2A illustrates a perspective view showing a front surface of a mobile device according to various exemplary embodiments of the present disclosure. FIG. 2B illustrates a perspective view showing a rear surface of a mobile device according to various exemplary embodiments of the present disclosure.

Referring to FIGS. 2A and 2B, a touch screen 190 is formed on the center of the front surface 100*a* of the mobile device 100. The touch screen 190 is formed so large that the touch screen 190 occupies the greatest part of the front surface 100*a* of the mobile device 100. In FIG. 2A, a main home screen is displayed on the touch screen 190 by way of an example. The main home screen is the first screen that is displayed on the touch screen 190 when the mobile device 100 is turned on. In addition, when the mobile device 100 has different home screens of a plurality of pages, the main home screen can be the first home screen from the home screens of the plurality of pages. Shortcut icons 191-1, 191-2, and 191-3 for executing frequently used applications, a main menu shift key 191-4, a date, weather, and the like are displayed on the home screen. The main menu shift key 191-4 displays a menu screen on the touch screen 190. In addition, a status bar 192 for displaying a status of the mobile device 100, such as a battery charging status, strength of a received signal, and a current time, are formed on the upper end of the touch screen 190.

A home button 161*a*, a menu button 161*b*, and a back button 161*c* are formed on the lower portion of the touch screen 190. The home button 161*a* displays a main home screen on the touch screen 190. For example, in a state in which a home screen other than the main home screen or a menu screen is displayed on the touch screen 190, when the home button 161*a* is touched, the main home screen is displayed on the touch screen 190. In addition, when the home button 161*a* is touched while applications are being executed on the touch screen 190, the main home screen shown in FIG. 2A is displayed on the touch screen 190. In addition, the home button 161*a* is used to display recently used applications or a task manager on the touch screen 190.

The menu button 161*b* provides a connection menu that may be used on the touch screen 190. The connection menu includes a widget add menu, a background screen change menu, a search menu, an edition menu, an environment setting menu, and so forth.

The back button 161*c* displays a screen that has been executed right before a currently executed screen or ends a most recently used application.

A first camera 151, an illumination sensor 170*a*, and a proximity sensor 170*c* can be arranged on the edge of the front surface 100*a* of the mobile device 100. A second camera 152, a flash 153, and a speaker 163 are arranged on the rear surface 100*c* of the mobile device 100. A power/reset button 160*a*, a volume button 161*b*, a terrestrial Digital Multimedia Broadcasting (DMB) antenna 141*a* for receiving broadcasts, one or more microphones 162, and the like, are arranged on a side surface 100*b* of the mobile device 100. The DMB antenna 141*a* is fixed to the mobile device 100 or is formed to be attachable to or detachable from the mobile device 100. In addition, a connector 165 is formed on a lower side surface of the mobile device 100. The connector 165 has a plurality of electrodes formed therein and can be connected to an external device via a wire. An earphone connection jack 167 is formed on an upper side surface of the mobile device 100. An earphone can be inserted into the earphone connection jack 167.

Figure 3:
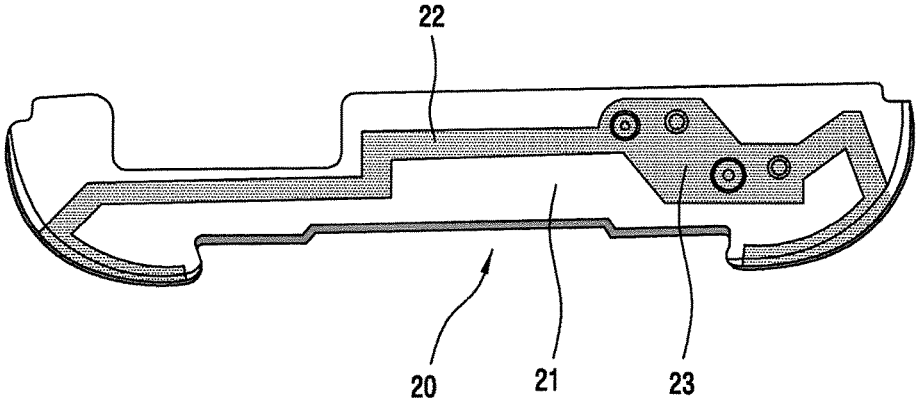
FIG. 3 illustrates a plane view showing an antenna according to various embodiments.
Figure 4:
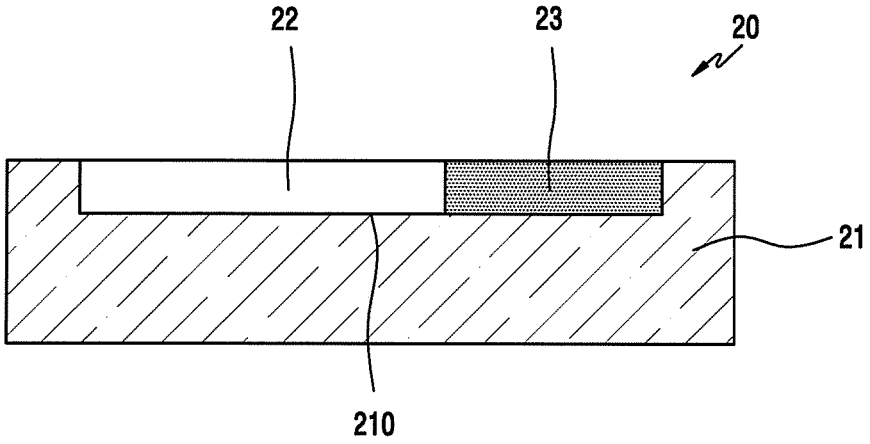
FIG. 4 illustrates a cross section view showing a configuration of an antenna according to various embodiments.
Figure 5:
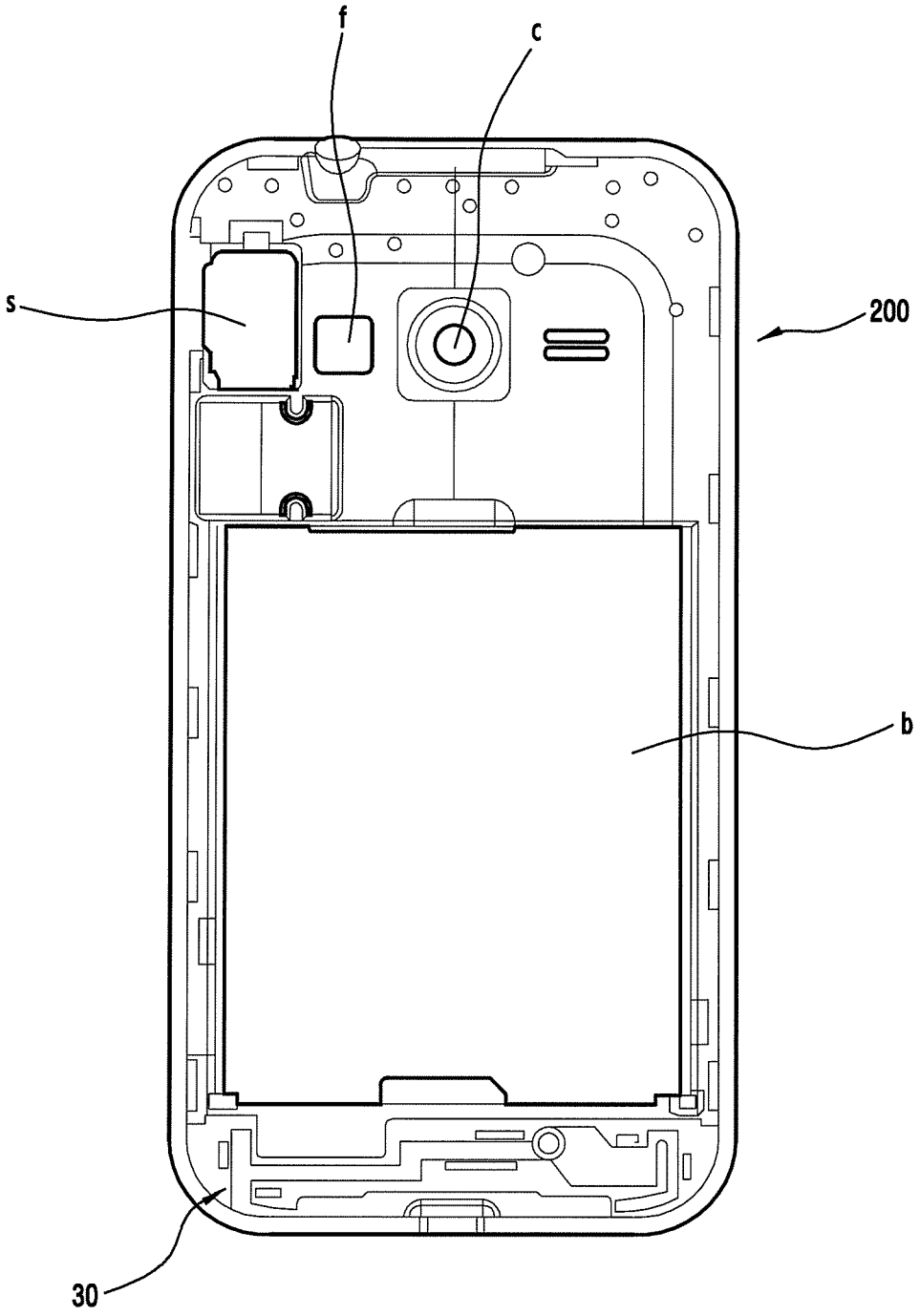
FIG. 5 illustrates a front view showing an antenna device which is mounted in a rear case of a mobile device according to various embodiments of the present disclosure.
Figure 6:
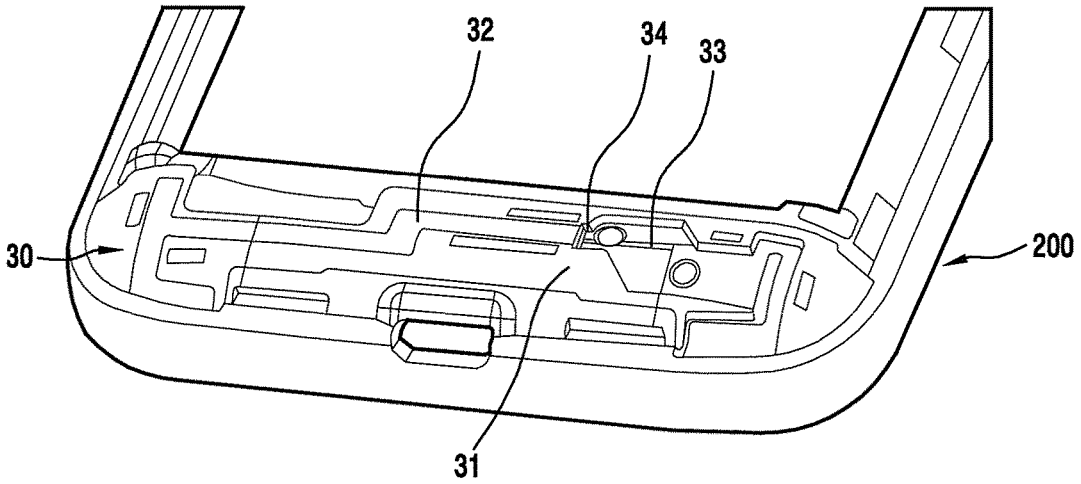
FIG. 6 illustrates a perspective view showing an antenna device which is mounted in a rear case of a mobile device according to various embodiments of the present disclosure.

FIG. 3 illustrates a plane view showing an antenna according to various exemplary embodiments. FIG. 4 illustrates a cross section view showing a configuration of an antenna according to various exemplary embodiments.

Referring to FIGS. 3 and 4, an antenna 20 employed in a mobile device according to an exemplary embodiment includes an antenna carrier 21 and first and second antenna radiator 22 and 23. The first and second antenna radiator 22 and 23 is disposed on one surface of the antenna carrier 21. The first and second antenna radiator 22 and 23 are disposed on the same surface 210 of the antenna carrier 21 in parallel with each other. The first antenna radiator 22 can be a low-band antenna pattern, and the second antenna radiator 23 can be a high-band antenna pattern.

The first antenna radiator 32 can be configured in a low-band antenna pattern, and the second antenna radiator 33 can be configured in a high-band antenna pattern. Therefore, the first antenna radiator 32 can be a low-band antenna and the second antenna radiator 33 can be a high-band antenna. In addition, the first antenna radiator 32 can be provided on the first surface 310 of the antenna carrier in a layered form, and the second antenna radiator 33 can be provided on the second surface 312 of the antenna carrier in a layered form. As described above, the first and second antenna radiator 32 and 33 form respective layers, and the layers are formed by plating with emitter material or using a thin plate of emitter material.

When the recessed depth of the second surface 312 is formed within the thickness of the first antenna radiator 32, the first and second antenna radiator 32 and 33 can be connected with each other at the stepped portion 34 and thus integrally formed with each other. In addition, when the recessed depth of the second surface 312 exceeds the thickness of the first antenna radiator 32, the first and second antenna radiator 32 and 33 are disconnected from each other at the stepped portion 34 and thus separated from each other. The separated antenna radiator will be explained later.

In addition, the first antenna radiator 32 is configured in the form of a planar surface or a curved surface or a combination of a planar surface and a curved surface. The first antenna radiator 32 reconfigured in a form corresponding to the first surface 310 of the antenna carrier. The second antenna radiator 33 is configured in the form of a planar surface or a curved surface or a combination of a planar surface and a curved surface. The second antenna radiator 33 is configured in a form corresponding to the second surface 312 of the antenna carrier. The first and second antenna radiator 32 and 33 are provided on the first and second surfaces, respectively, with uniform thicknesses. According to the above-described configuration, the antenna 30 can minimize degradation of an OTA characteristic while reducing an SAR. In this case, it should be noted that the first and second antenna radiator 32 and 33 are disposed in the antenna carrier 31 with their respective effective volumes being maintained.

Figure 8:
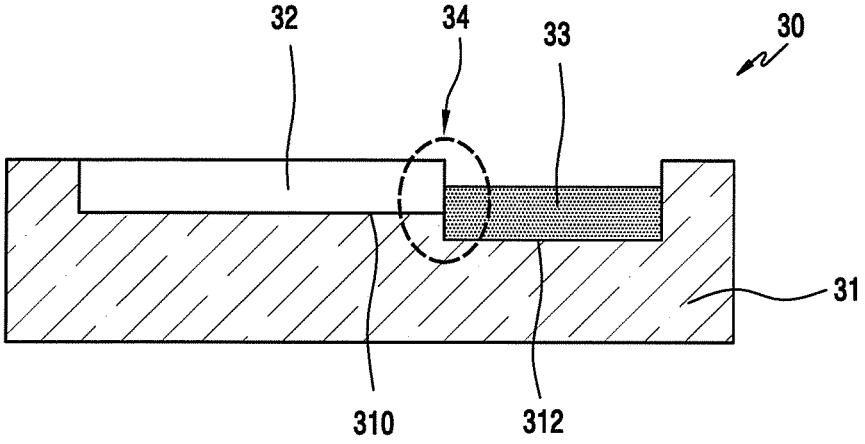
FIG. 8 illustrates a cross section view showing a configuration of an antenna according to various embodiments of the present disclosure.
Figure 9:
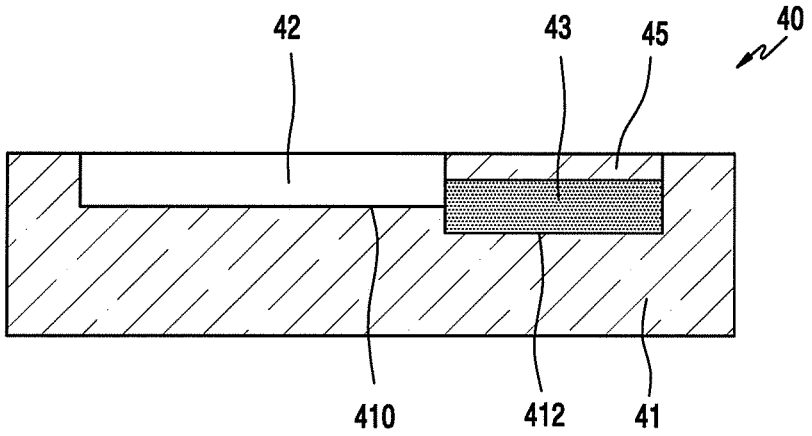
FIG. 9 illustrates a cross section view showing a configuration of an antenna according to various embodiments of the present disclosure.

FIG. 9 illustrates a cross section view showing an antenna 40 according to various exemplary embodiments of the present disclosure. Referring to FIG. 9, the antenna 40 is the same as the antenna 30 shown in FIG. 8 except for that an auxiliary antenna carrier 45 is further provided on the top surface of a second antenna emitter. Therefore, the same elements will not be described and only the additional auxiliary antenna carrier 45 will be described.

When first and second antenna radiator 42 and 43 have the same thickness and a second surface 412 of an antenna carrier is recessed from a first surface 410 within the thickness of the first antenna radiator 42, the second antenna radiator 43 is disposed to be stepped from the first antenna radiator 42. The top surface of the first antenna radiator 42 and the top surface of the second antenna radiator 43 are stepped from each other by the recessed depth. Therefore, the auxiliary antenna carrier 45 is further provided on the top surface of the second antenna radiator 43. The auxiliary antenna carrier 45 occupies a space as much as the recessed depth of the second antenna radiator 43. The top surface of the first antenna radiator 43 and the top surface of the auxiliary antenna carrier 45 are formed to have the same plane. However, the top surface of the auxiliary antenna carrier 45 is formed to have the substantially same plane as the top surface of the antenna carrier 41. According to the above-described arrangements of the antenna radiator, the antenna can minimize degradation of an OTA characteristic while reducing an SAR. According to the above-described configuration, the second antenna radiator 43 is embedded in the antenna carrier 41 such that it cannot be viewed from the outside. In addition, when the second antenna radiator 43 is formed of a thin plate of emitter material, the second antenna radiator 43 is manufactured along with the antenna carrier 41 by insert molding. When the first antenna radiator 42 is formed of a thin plate of radiator material, the first antenna radiator 42 is manufactured along with the antenna carrier 41 by insert molding. According to the above-described arrangements of the antenna radiator, the antenna 40 can minimize degradation of an OTA characteristic while reducing an SAR. In this case, it should be noted that the first and second antenna radiator 42 and 43 are disposed in the antenna carrier 41 with their respective effective volumes being maintained.

Figure 10:
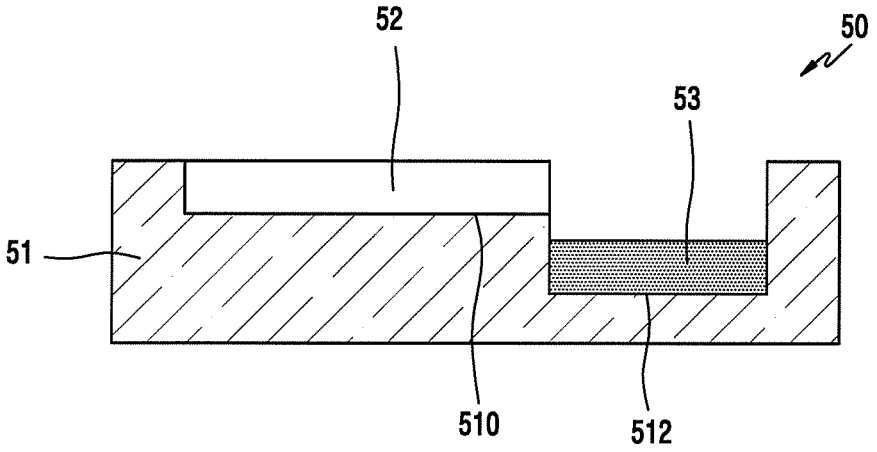
FIG. 10 illustrates a cross section view showing a configuration of an antenna according to various embodiments of the present disclosure.

FIG. 10 illustrates a cross section view showing an antenna 50 according to various exemplary embodiments of the present disclosure. Referring to FIG. 10, the antenna 50 is the same as the antenna 30 shown in FIG. 8 except for the recessed depth of a second antenna radiator 53, and thus the same elements will not be described.

When first and second antenna radiator 52 and 53 have the same thickness and a second surface 512 of an antenna carrier 51 is recessed from a first surface 510 by more than the thickness of the first antenna radiator 52, the second antenna radiator 53 is disposed to be stepped from the first antenna radiator 52 and is separated from the first antenna radiator 52 in the vertical direction. The top surface of the first antenna radiator 52 and the top surface of the second antenna radiator 53 are stepped from each other by the recessed depth. Additionally, although not shown in FIG. 10, an additional antenna carrier can be provided on the top surface of the second antenna radiator 53. According to the above-described arrangements of the antenna emitters, the antenna 50 can minimize degradation of an OTA characteristic while reducing an SAR. In this case, it should be noted that the first and second antenna radiator 52 and 53 are disposed in the antenna carrier 51 with their respective effective volumes being maintained.

Figure 11:
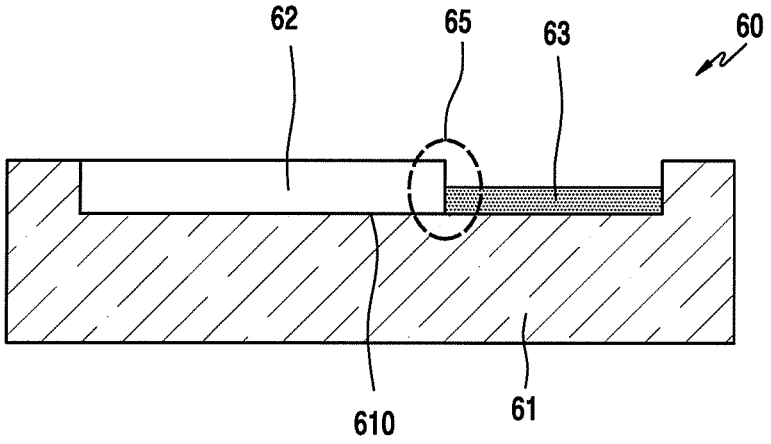
FIG. 11 illustrates a cross section view showing a configuration of an antenna according to various embodiments of the present disclosure.

FIG. 11 illustrates a cross section view showing an antenna 60 according to various exemplary embodiments of the present disclosure. Referring to FIG. 11, compared with the antenna 30 shown in FIG. 8, the antenna 60 is configured such that the thickness of a second antenna radiator 63 mounted on one surface of an antenna carrier 61 is thinner than the thickness of a first antenna radiator 62.

When the thickness of the second antenna radiator 63 is thinner than the thickness of the first antenna radiator 62 on the same one surface 610 of the antenna carrier 61, the second antenna radiator 63 can be disposed to be stepped from the first antenna radiator 62. The second antenna radiator 63 can be stepped from the first antenna radiator 62 by less than the thickness of the first antenna radiator 62. A stepped portion 65 can be formed between the first and second antenna radiator 62 and 63 and integrally connect the first and second antenna radiator 62 and 63.

Additionally, although not shown in FIG. 11, an additional antenna carrier may be provided on the top surface of the second antenna emitter 63. According to the above-described arrangements of the antenna emitters, the antenna 60 can minimize degradation of an OTA characteristic while reducing an SAR. In this case, it should be noted that the first and second antenna radiator 62 and 63 are disposed in the antenna carrier 61 with their respective effective volumes being maintained.

Figure 12:
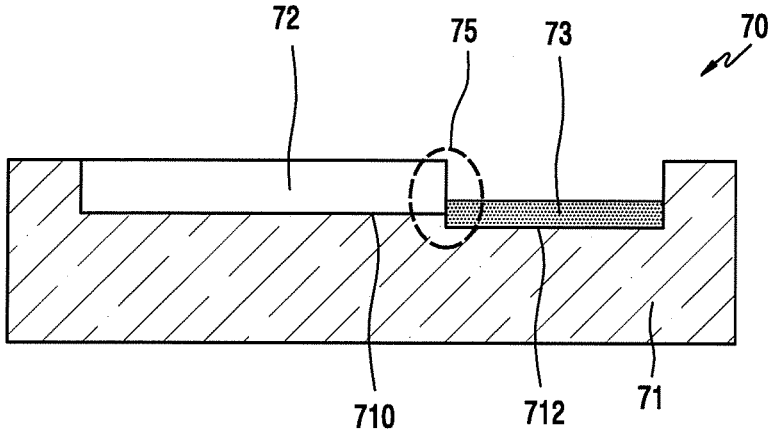
FIG. 12 illustrates a cross section view showing a configuration of an antenna according to various embodiments of the present disclosure.

FIG. 12 illustrates a cross section view showing an antenna 70 according to various exemplary embodiments of the present disclosure. Referring to FIG. 12, compared with the antenna 30 shown in FIG. 8, the antenna 70 is configured such that the thickness of a second antenna radiator 73 is thinner than the thickness of a first antenna radiator 72, and the recessed depth of a second surface 712 with reference to a first surface 710 is within the thickness of the second antenna radiator 72. An antenna carrier 71 includes the first surface 710 and the second surface 712 which is recessed from the first surface 710 within the thickness of the second antenna radiator 73. The first antenna radiator 72 is provided on the first surface 710 and the second antenna radiator 73 is provided on the second surface 712.

When the thickness of the second antenna radiator 73 is thinner than the thickness of the first antenna radiator 72 and the recessed depth of the second surface 712 is within the thickness of the second antenna radiator 73, a stepped portion 75 is formed between the first and second antenna radiator 72 and 73. Additionally, although not shown in FIG. 12, an additional antenna carrier is provided on the top surface of the second antenna radiator 73. According to the above-described arrangements of the antenna emitters, the antenna 70 can minimize degradation of an OTA characteristic while reducing an SAR. In this case, it should be noted that the first and second antenna radiator 72 and 73 are disposed in the antenna carrier 71 with their respective effective volumes being maintained.

Figure 13:
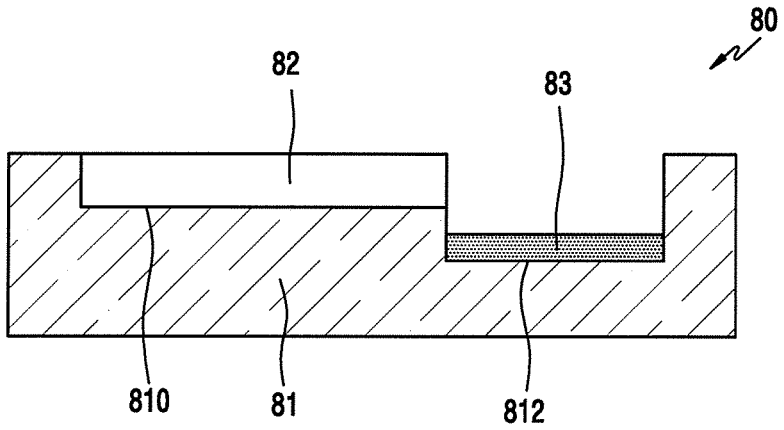
FIG. 13 illustrates a cross section view showing a configuration of an antenna according to various embodiments of the present disclosure.

FIG. 13 illustrates a cross section view showing an antenna 80 according to various exemplary embodiments of the present disclosure. Referring to FIG. 13, compared with the antenna 30 shown in FIG. 8, the antenna 80 is configured such that the thickness of a second antenna emitter 83 is thinner than the thickness of a first antenna radiator 82 and the recessed depth of a second surface 812 with reference to a first surface 810 is formed by more than the thickness of the first antenna radiator 82. An antenna carrier 81 includes the first surface 810 and the second surface 812 that is recessed from the first surface 810 by more than the thickness of the first antenna radiator 82. The first antenna radiator 82 is provided on the first surface 810 in parallel with the first surface 810, and the second antenna radiator 83 is provided on the second surface 812 in parallel with the second surface 812.

When the thickness of the second antenna radiator 83 is thinner than the thickness of the first antenna radiator emitter 82 and the recessed depth of the second surface 812 exceeds the thickness of the first antenna radiator 82, the second antenna radiator 83 is disposed to be stepped from the first antenna radiator 82. According to the above-described arrangements of the antenna emitters, the antenna 80 can minimize degradation of an OTA characteristic while reducing an SAR. Additionally, although not shown in FIG. 13, an additional antenna carrier can be provided on the top surface of the second antenna radiator 83. In this case, it should be noted that the first and second antenna radiator 82 and 83 are disposed in the antenna carrier 81 with their respective effective volumes being maintained.

Hereinafter, SAR measurement data according to various exemplary embodiments of the present disclosure will be explained. First, the SAR of a mobile device can be measured through "0 mm SAR" measurement. The 0 mm SAR measurement refers to a method for measuring an SAR by bringing a mobile device into close contact with a user body.

In addition, other methods for measuring an SAR of a mobile device include measuring "0 mm body SAR" or "Limb SAR." The "0 mm body SAR" measurement method is measuring an SAR by bringing a mobile device into close contact with a user body, and the "Limb SAR" measurement method is measuring SARs by bringing the front surface, rear surface, and plurality of side surfaces of a mobile device into close contact with the human body.

Hereinafter, comparison data resulting from 0 mm SAR measurement between a basic antenna and an antenna to which the present disclosure is applied will be explained with reference to table 1 presented below:

TABLE 1

| | | basic antenna | antenna to which the present disclosure is applied |
|---|---|---|---|
| Limb SAR (backside) | WCDMA B1 (2.1 GHz) | 3.8 mW/g (10 g) | 2.7 mW/g (10 g) |
| | LTE B7 (2.5 GHz) | 3.346 mW/g (10 g) | 2.96 mW/g (10 g) |

Figure 7:
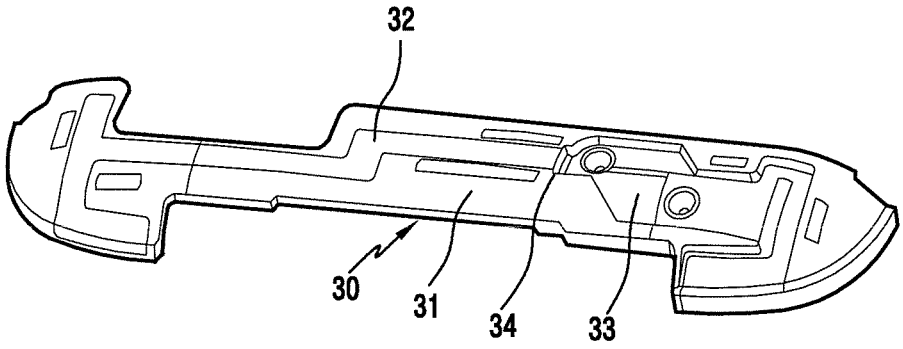
FIG. 7 illustrates a perspective view showing an antenna device according to various embodiments of the present disclosure.

According to the result of measuring an SAR by bringing a mobile device into close contact with the human body, the antenna 30 according to various exemplary embodiments of the present disclosure shown in FIGS. 7 and 8 can prevent degradation of an OTA characteristic and reduce an SAR in comparison with the basic antenna 20 shown in FIGS. 3 and 4.

According to various exemplary embodiments of the present disclosure, the second antenna emitter having a high-band antenna pattern is disposed to be recessed from the first antenna emitter by a predetermined depth, so that the antenna can prevent degradation of an OTA characteristic and reduce an SAR in comparison with the existing antenna.

According to various exemplary embodiments, at least part of the apparatus of the present disclosure is implemented by using instructions stored in a computer-readable storage medium in the form of a programming module. When the instructions are executed by one or more processors, the one or more processors perform a function corresponding to the instructions. The computer-readable storage medium may be a memory, for example. At least part of the programming module is implemented (for example, executed) by using the processor. At least part of the programming module includes a module, a program, a routine, sets of instructions, a process, and the like for performing one or more functions.

Examples of a computer-readable recording medium include magnetic media such as hard disks, floppy disks and magnetic tapes, optical media such as Compact Disc Read Only Memories (CD-ROMs) and Digital Versatile Disc (DVDs), magneto-optical media such as floptical disks, and hardware devices such as Read Only Memories (ROMs), Random Access Memories (RAMs) and flash memories that are especially configured to store and execute program commands (for example, the programming module). Examples of the program commands include machine language codes created by a compiler, and high-level language codes that can be executed by a computer by using an interpreter. The above-described hardware devices may be configured to operate as one or more software modules for performing operations of various exemplary embodiments of the present disclosure, and vice versa.

A module or programming module according to various exemplary embodiments of the present disclosure may include one or more of the above-described elements, may omit some elements, or may further include additional other elements. The operations performed by the module, the programming module, or the other elements according to various exemplary embodiments of the present disclosure may be performed serially, in parallel, repeatedly, or heuristically. In addition, some operation may be performed in different order or may omitted, and an additional operation may be added.

While the disclosure has been shown and described with reference to certain preferred embodiments thereof, it will be understood by those skilled in the art that various changes in form and details may be made therein without departing from the spirit and scope of the disclosure as defined by the appended claims. Therefore, the scope of the disclosure is defined not by the detailed description of the disclosure but by the appended claims, and all differences within the scope will be construed as being included in the present disclosure.

What is claimed is:

1. An antenna of a mobile device, comprising:

an antenna carrier; and first and second antenna radiator configured to maintain an over-the-air-radio frequency (RF) performance (OTA) and reduce a specific absorption rate (SAR) and maintain respective effective volumes, the first antenna radiator disposed on a first surface of the antenna carrier and the second antenna radiator disposed on a second surface of the antenna carrier, wherein the second surface is recessed from the first surface so that a stepped portion is provided between the first surface and the second surface, wherein an auxiliary antenna carrier having a predetermined thickness is additionally provided on a top surface of the second antenna radiator, such that the auxiliary antenna carrier covers the second antenna radiator.

2. The antenna of claim 1, wherein the second antenna radiator extends from the first antenna radiator in an extending direction of the first antenna radiator at the stepped portion, while maintaining a height difference between the first surface and the second surface.

3. The antenna of claim 1, wherein the second antenna radiator is disposed to be recessed and stepped by a predetermined depth within the predetermined thickness of the first antenna radiator.

4. The antenna of claim 1, wherein the first antenna radiator is configured in a low-band antenna pattern and the second antenna radiator is configured in a high-band antenna pattern.

5. The antenna of claim 1, wherein the first and second antenna radiator are integrally manufactured with each other and are integrally mounted on a top surface of the antenna carrier, or are independently manufactured and separately disposed on the top surface of the antenna carrier at a distance from each other.

6. The antenna of claim 1, wherein the first and the second antenna radiator are configured to have a same thickness or a different thickness.

7. The antenna of claim 1, wherein the first and the second antenna radiator are formed by coating or thin plate.

8. The antenna of claim 1, wherein a top surface of the auxiliary antenna carrier is formed on a same plane as a top surface of the first antenna radiator.

9. The antenna of claim 1, wherein the first and the second surfaces are configured by a planar surface or a curved surface or a combination of a planar surface and a curved surface, and the first and the second antenna radiator are configured by a planar surface or a curved surface or a combination of a planar surface and a curved surface.

10. A mobile device comprising:

a body; and an embedded antenna comprising:

an antenna carrier mounted within the body, and first and second antenna radiator configured to maintain an over-the-air-radio frequency (RF) performance (OTA) and reduce a specific absorption rate (SAR) and maintain respective effective volumes, the first antenna radiator disposed on a first surface of the antenna carrier and the second antenna radiator disposed on a second surface of the antenna carrier, wherein the second surface is recessed from the first surface by a predetermined depth so that a stepped portion is provided between the first surface and the second surface, wherein an auxiliary antenna carrier having a predetermined thickness is additionally provided on a top surface of the second antenna radiator, such that the auxiliary antenna carrier covers the second antenna radiator.

11. The mobile device of claim 10, wherein the first antenna radiator is formed by plating the first surface with a low-band antenna pattern, and the second antenna radiator is formed by plating the second surface with a high-band antenna pattern.

12. The mobile device of claim 11, wherein the first and the second antenna radiator are configured to have a same thickness, and are integrally configured on the first and the second surfaces or separately configured on the first and the second surfaces.

13. The mobile device of claim 11, wherein the first and the second antenna radiator are configured to have a different thickness, and are integrally configured on the first and the second surfaces or separately configured on the first and the second surfaces.

14. The mobile device of claim 11, wherein the first and the second antenna radiator are configured in a layered form.

15. The mobile device of claim 11, wherein the stepped portion is provided on a boundary area between the first and the second antenna radiator.

16. The mobile device of claim 10, wherein the embedded antenna is mounted at a lower end of a rear case of the body.

* * * * *